US009675167B2

(12) United States Patent
Xavier et al.

(10) Patent No.: US 9,675,167 B2
(45) Date of Patent: Jun. 13, 2017

(54) MULTIDIMENSIONAL APPLICATOR

(71) Applicants: Simone Rodrigues Oliveira Xavier, Fort Lauderdale, FL (US); Rene Xavier Filho, Fort Lauderdale, FL (US)

(72) Inventors: Simone Rodrigues Oliveira Xavier, Fort Lauderdale, FL (US); Rene Xavier Filho, Fort Lauderdale, FL (US)

(73) Assignee: Sigma Enterprises, LLC, New Brighton, MN (US)

( * ) Notice: Subject to any disclaimer, the term of this patent is extended or adjusted under 35 U.S.C. 154(b) by 358 days.

(21) Appl. No.: 14/482,062

(22) Filed: Sep. 10, 2014

(65) Prior Publication Data

US 2016/0066681 A1 Mar. 10, 2016

(51) Int. Cl.
*A46B 9/02* (2006.01)
*A45D 40/26* (2006.01)

(52) U.S. Cl.
CPC ..... *A46B 9/021* (2013.01); *A45D 40/262* (2013.01); *A46B 9/026* (2013.01); *A46B 9/028* (2013.01); *A46B 2200/1046* (2013.01)

(58) Field of Classification Search
CPC ..... A46D 1/0284; A46D 1/0276; A46B 2200/104; A46B 9/021; A46B 2200/1046; A46B 2200/1053; A46B 9/026; A46B 9/028; A46B 9/06; A46B 9/02; A46B 3/005; A46B 2200/202; A45D 40/262
See application file for complete search history.

(56) References Cited

U.S. PATENT DOCUMENTS

| | | | | |
|---|---|---|---|---|
| 2,122,980 A | | 7/1938 | Grumbacher | |
| 2,849,740 A | | 9/1958 | Pauker | |
| 3,333,289 A | * | 8/1967 | Maughan | A46B 9/02 15/160 |
| D249,600 S | | 9/1978 | Bowman | |
| 4,360,940 A | | 11/1982 | Smith | |
| D267,986 S | | 2/1983 | Flower | |
| D278,952 S | | 5/1985 | Kalinsky | |
| D304,392 S | * | 11/1989 | Reich | D4/135 |

(Continued)

FOREIGN PATENT DOCUMENTS

| | | |
|---|---|---|
| JP | 09191935 A | 7/1997 |
| JP | 10165224 A | 6/1998 |

(Continued)

OTHER PUBLICATIONS

The extended European Search Report of European application No. 14197599.5 dated Mar. 13, 2015.

(Continued)

*Primary Examiner* — Robert Scruggs
(74) *Attorney, Agent, or Firm* — Dorsey & Whitney LLP

(57) ABSTRACT

An applicator, such as a brush or other device, for applying products to a surface, such as the skin of a person. The applicator includes a handle and a bristle tuft connected to the handle. The bristle tuft may include a plurality of contoured bristles that define multiple surfaces for applying products. For example, the bristle tuft may include a first angled surface extending upwards from a first side of the bristle tuft, a second angled surface extending upwards from a second side of the bristle tuft, and a ridge defined at an intersection of the first angled surface and the second angled surface.

20 Claims, 8 Drawing Sheets

(56) References Cited

U.S. PATENT DOCUMENTS

| | | | | |
|---|---|---|---|---|
| 4,952,894 | A | 8/1990 | Connerney | |
| D324,776 | S | 3/1992 | Griffin et al. | |
| D333,572 | S | 3/1993 | Jansen et al. | |
| D350,853 | S | 9/1994 | Basque | |
| 5,450,865 | A | 9/1995 | Park | |
| D380,615 | S | 7/1997 | Roberts | |
| 5,689,872 | A | 11/1997 | Forsline | |
| D387,564 | S | 12/1997 | Talbot | |
| 5,862,559 | A | 1/1999 | Hunter | |
| 5,906,434 | A | 5/1999 | Berrios | |
| 5,943,836 | A | 8/1999 | Kassardjian | |
| D421,846 | S | 3/2000 | Choe | |
| D427,065 | S | 6/2000 | Sagel | |
| D427,777 | S | 7/2000 | Kim | |
| D428,706 | S | 8/2000 | Thunderchild | |
| D439,838 | S | 4/2001 | Sagel | |
| D442,083 | S | 5/2001 | Hoffman | |
| D446,654 | S | 8/2001 | Berni | |
| D450,189 | S | 11/2001 | Mink et al. | |
| D450,931 | S | 11/2001 | Mink et al. | |
| D471,018 | S | 3/2003 | Mink | |
| D479,917 | S | 9/2003 | Mink | |
| D479,918 | S | 9/2003 | Mink | |
| D514,816 | S | 2/2006 | Clapperton | |
| D518,962 | S | 4/2006 | Hay et al. | |
| D529,815 | S | 10/2006 | Frasier | |
| D571,559 | S | 6/2008 | Riaz | |
| D572,010 | S | 7/2008 | Riaz | |
| D575,635 | S | 8/2008 | Rozenzweig | |
| D591,512 | S | 5/2009 | Mongeon et al. | |
| D591,618 | S | 5/2009 | Keberlein | |
| D599,116 | S | 9/2009 | Dumler | |
| D601,349 | S | 10/2009 | Wales | |
| D603,610 | S | 11/2009 | Dumler | |
| D625,522 | S | 10/2010 | Riaz | |
| D626,338 | S | 11/2010 | Ajootian | |
| 7,895,698 | B2 | 3/2011 | Mink | |
| D663,957 | S | 7/2012 | Garcia | |
| D672,233 | S | 12/2012 | Green | |
| D672,661 | S | 12/2012 | Hora | |
| D686,417 | S | 7/2013 | Pope | |
| 8,549,692 | B2 * | 10/2013 | Befve | A46B 9/021 15/160 |
| D693,366 | S | 11/2013 | Daniel | |
| D695,102 | S | 12/2013 | Keberlein | |
| D706,542 | S | 6/2014 | Lavigne | |
| D710,617 | S | 8/2014 | Mink | |
| D718,941 | S | 12/2014 | Matsuishi | |
| 2005/0000976 | A1 | 1/2005 | Keberlein | |
| 2006/0123576 | A1 * | 6/2006 | Howard | A46B 9/021 15/195 |
| 2007/0151061 | A1 | 7/2007 | Mink et al. | |
| 2011/0284019 | A1 | 11/2011 | Fairweather | |
| 2014/0196237 | A1 | 7/2014 | Dale | |

FOREIGN PATENT DOCUMENTS

| | | | |
|---|---|---|---|
| JP | 2011087675 | A | 5/2011 |
| KR | 30-0280944 | S | 10/2001 |

OTHER PUBLICATIONS

CN 300777012 Patent Detail of Registered Design (Shiseido Co, Ltd.) May 14, 2008. Retrieved May 25, 2015 from <http://epub.sipo.gov.cn>.

Examination report dated Mar. 31, 2017 received in connection with European Patent Application No. 14197599.5, 5 pages.

* cited by examiner

MULTIDIMENSIONAL APPLICATOR

TECHNICAL FIELD

The present disclosure relates to applicators and more particularly, to brushes for applying cosmetic products.

BACKGROUND

Many types of cosmetic products may be applied by a brush. For example, liquids, creams, powders, compact powders, and so on, may all be applied to a user's face, neck, or other regions by a brush. Most cosmetic brushes have a rounded or flat shape suited to apply products to the flat surfaces of a user's face or body. However, these types of brushes do not fit into creases or deep lines of a user's face, such as the sides of the user's nose, smile line, crease between the chin and inferior lips, or the like. Accordingly, typically users must stretch the skin in those areas in order to allow conventional brushes to apply product into the creases or lines. Further, many cosmetic brushes are designed for a single function, such as applying loose powder, and so if a user wants to apply different products or create certain features, such as contour lines or the like, he or she typically will be required to change brushes. As such, there is a need for a multifunctional brush that can be used for multiple products, texturing, contouring, and can access all surfaces on a user's face.

SUMMARY

One example of the present disclosure may take the form of an applicator, such as a brush or other device, for applying products to a surface, such as the skin of a person. The applicator includes a handle and a bristle tuft connected to the handle. The bristle tuft may include a plurality of contoured bristles that define multiple surfaces for applying products. For example, the bristle tuft may include a first angled surface extending upwards from a first side of the bristle tuft, a second angled surface extending upwards from a second side of the bristle tuft, and a ridge defined at an intersection of the first angled surface and the second angled surface.

Another example of the present disclosure may take the form of a brush for applying cosmetic products including a handle and a plurality of bristles arranged in a cluster and connected to a top end of the handle, a top end of the plurality of bristles defining an application feature defining a first wedge surface, a second wedge surface, and a crest defined at an intersection between the first wedge and the second wedge.

Yet another example may take the form of a cosmetic applicator for applying cosmetic products to a surface. The applicator may include a bristle tuft comprising a plurality of bristles secured together. The plurality of bristles may have varying lengths to define an applicator topography. The applicator topography includes a first angled wedge defined on a first side of the bristle tuft and angled towards a center of the bristle tuft, a second angled wedge defined on a second side of the bristle tuft and angled towards the center of the bristle tuft, and a ridge defined across the intersection of the first angled surface and the second angled surface, where a set of ridge bristles are longer than the remaining bristles in the plurality of bristles.

While multiple examples are disclosed, still other examples of the present invention will become apparent to those skilled in the art from the following detailed description, which shows and describes illustrative examples of the invention. As will be realized, the invention is capable of modifications in various aspects, all without departing from the spirit and scope of the present invention. Accordingly, the drawings and detailed description are to be regarded as illustrative in nature and not restrictive.

OVERVIEW

Figure 1A:
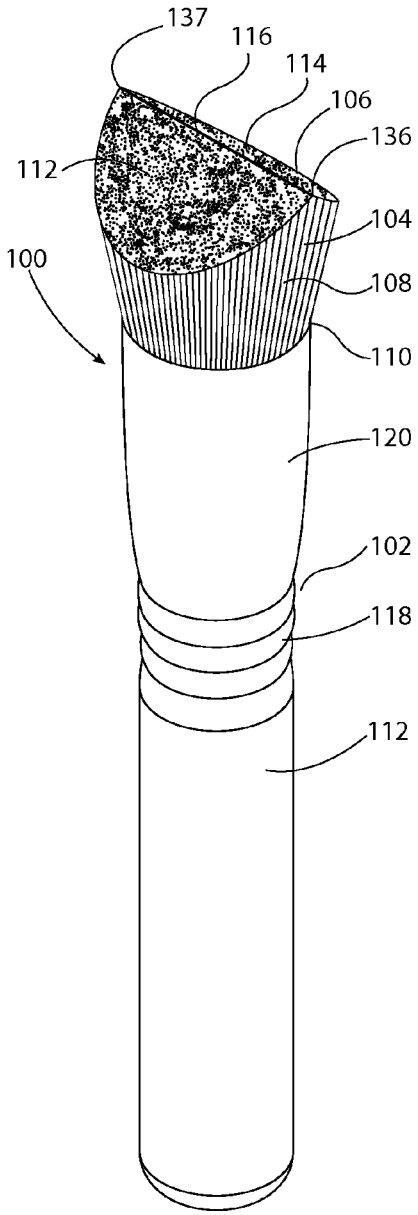
FIG. 1A is a top front isometric view of an applicator.

Some examples of the present disclosure include a three-dimensional or multidimensional applicator that may be used to apply cosmetic products, paint, or the like. The applicator is multifunctional and may be used to apply a variety of different types products, such as liquids, creams, powders, and so on, to various surfaces of a user's face, including flat surfaces, creases, crevices, and lines. In one embodiment, the applicator includes a handle and a brush top including a plurality of contoured bristles. The bristles may be various lengths with predetermined shapes, densities, and lengths to define the application contours for the applicator. The contours may be selected to provide functionality, as well as provide an aesthetically pleasing design and a recognizable appearance to a user.

In some embodiments, the contours of the bristles may be shaped so as to define symmetrically shaped, substantially planar, angled wedge surfaces that extend upwards from opposing sides of the brush top. The intersection of the two wedge surfaces defines a ridge that extends across a width of the brush top. In this embodiment, the bristles may form a pentagon shape on two sides of the bristle cluster as viewed from an elevation view of the applicator. The multiple contours defined by the shaped bristles allows a user to use the brush to apply cosmetic products to various areas of the face, without having to stretch his or her skin, switch brushes, or the like.

In some embodiments, the wedge surfaces may be used to apply cosmetic products to flat and slightly curved areas of the face and the symmetry of the wedge surfaces allows a user to use a first wedge surface to do an initial application of the product and a second wedge surface to do a finishing or smoothing application of the product. For example, the first wedge surface may be covered in the product (e.g., dipped, swiped, or otherwise dusted) and then may be used to apply the product to the user's face. The second wedge surface, which may be "clean" or otherwise not have the product on the end of the bristles, may then be used to smooth the applied product on the user's face, e.g., eliminate streaks or the like.

During application, the ridge or crest may be used to apply product to creases, sharp angles, and/or lines within a user's face (or other areas). For example, the user may apply product to the ridge and then may use the ridge to apply the product to the user's nose, smile line, chin crease, or the like. Due to the angled walls of the wedges, the ridge is oriented to fit within lines and creases, without requiring the user to stretch the skin in those locations. Further, the ridge may be used to precisely apply product to certain locations. For example, the sharp angle of the ridge may form a tip that may be used to accurately and specifically apply products to certain locations, which may be used to add contours or other detailed shapes and lines of product to a user's face. As some examples, the ridge may be used to apply product to the contours of a user's eyes and around the mouth.

In some embodiments, the bristles may have a density that allows "buffering" of the product onto the user's skin. For example, the bristles may have a density similar to a dense sponge material that has some rigidity to maintain its shape as a user applies pressure downwards onto the skin, but also flexes around the user's skin. Further, the bristles may have sufficiently fine fibers to allow coverage of skin pores. For example, the bristles may have a diameter ranging between 0.10 mm and 0.01 mm, and preferably may be 0.07 mm. The bristles are typically packed as tightly as possible into the upper end of the handle, so that the density of the bristles may be determined by the diameter of the handle and the diameter of each bristle.

DETAILED DESCRIPTION

Figure 1B:
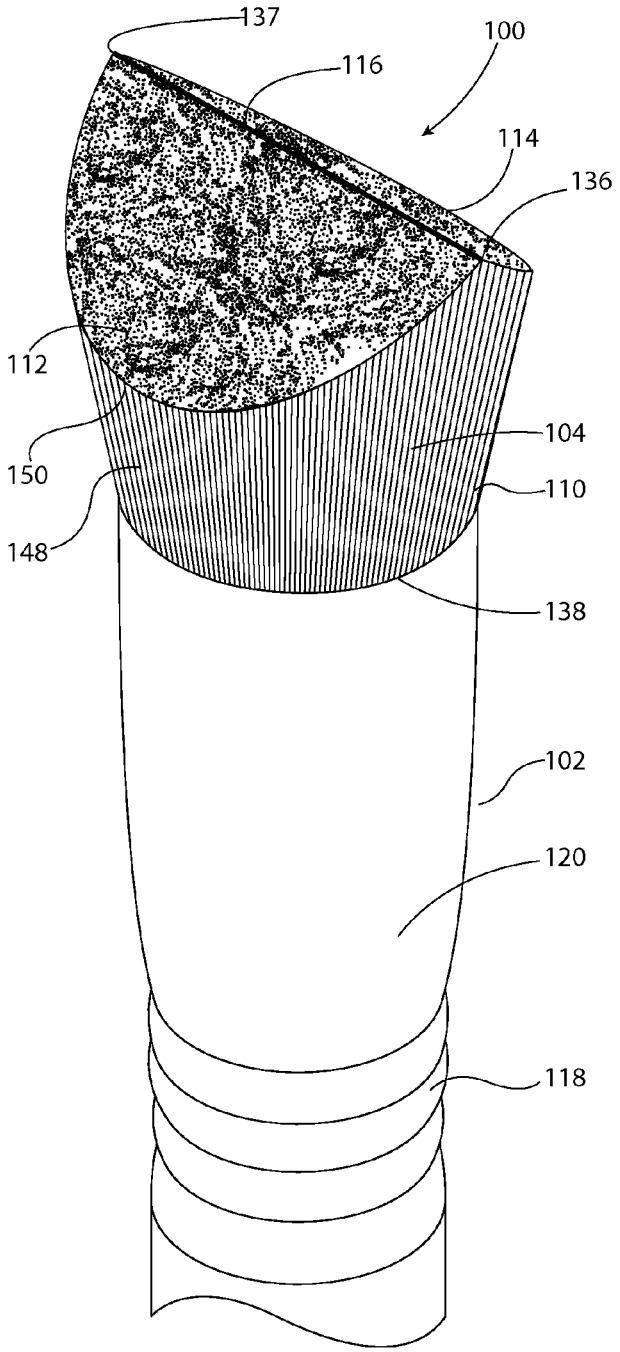
FIG. 1B is an enlarged view of the applicator.
Figure 2:
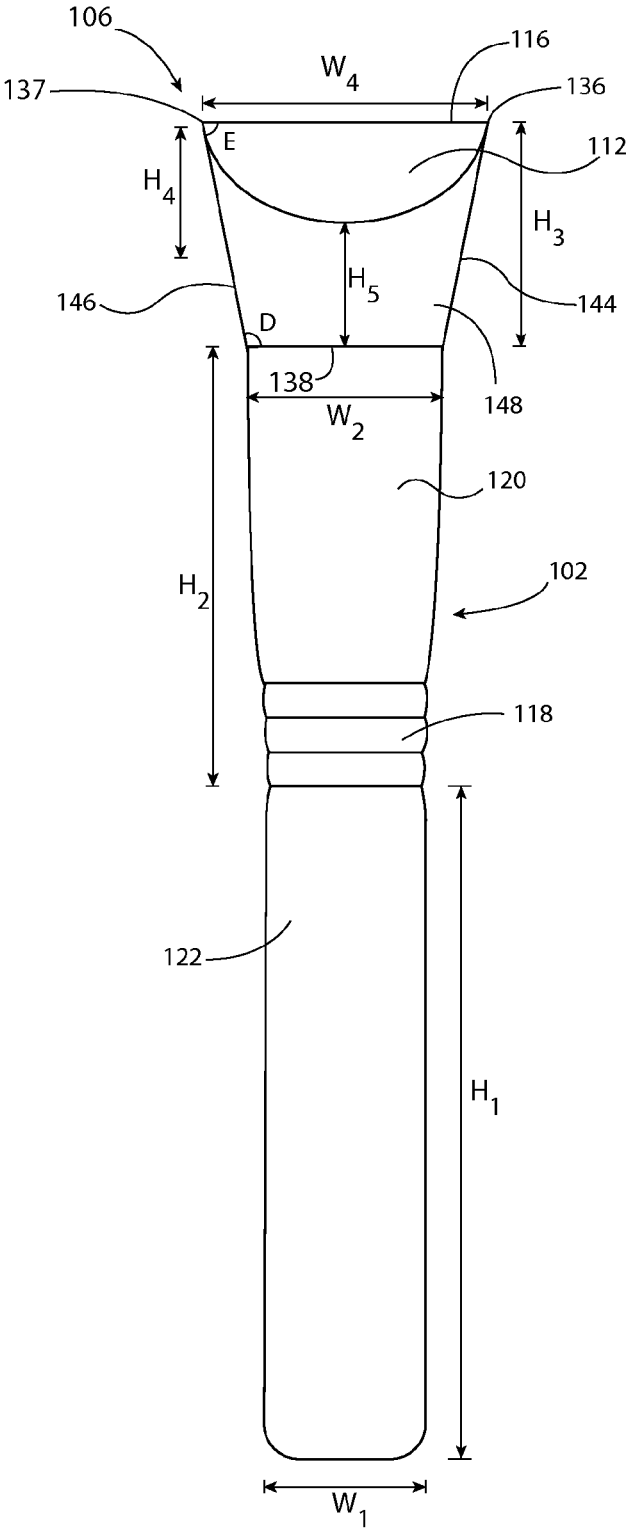
FIG. 2 is a front elevation view of the applicator.
Figure 3:
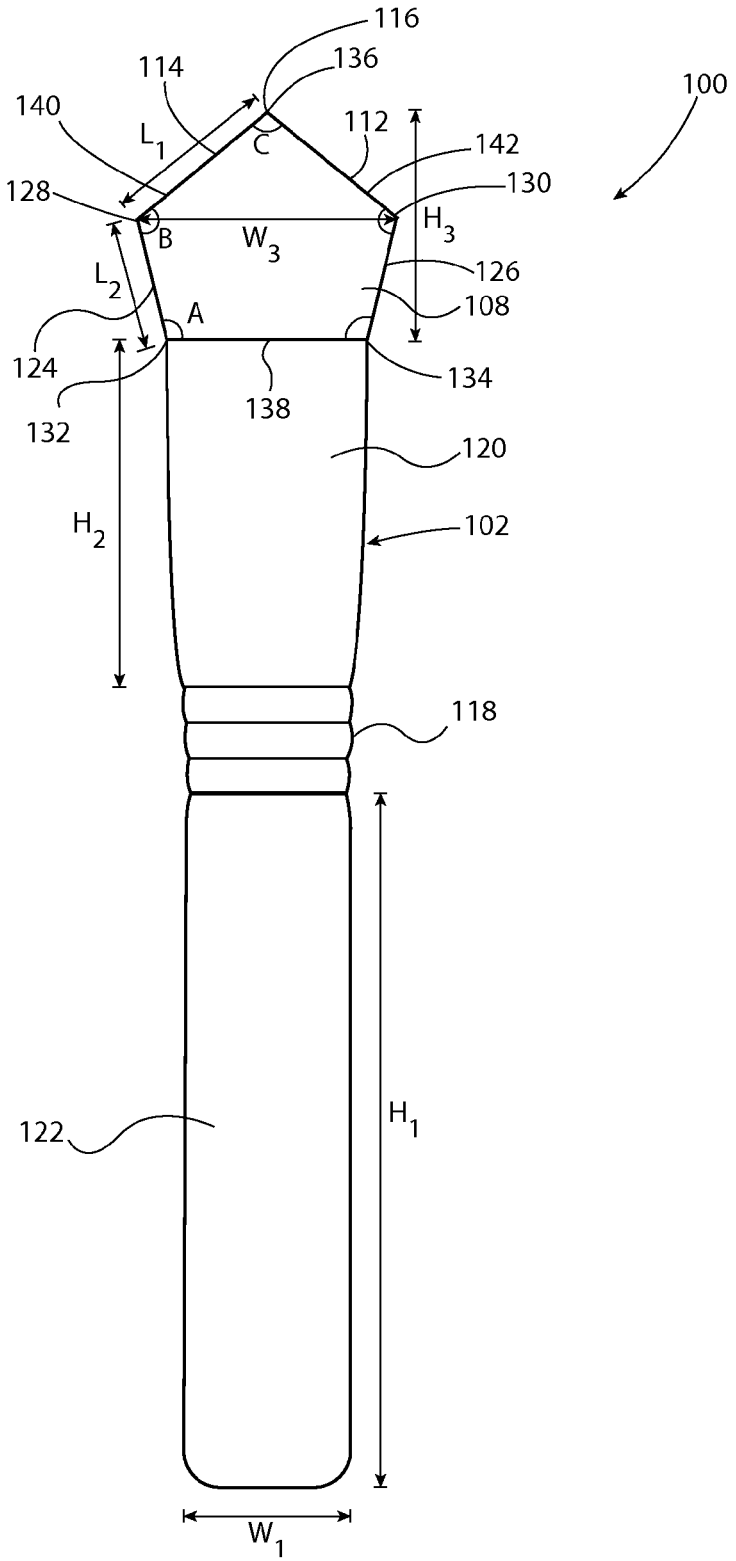
FIG. 3 is a side elevation view of the applicator.

Turning to the figures, the applicator of the present disclosure will be discussed in more detail. FIG. 1A is an isometric view of an applicator in accordance with the present disclosure. FIG. 1B is an enlarged isometric view of the applicator of FIG. 1A. FIG. 2 is a front elevation view of the applicator of FIG. 1. FIG. 3 is a side elevation view of the applicator of FIG. 1. With reference to FIGS. 1A-3, the applicator 100 may include a handle 102 and a bristle tuft 104 connected to the handle 102. The bristle tuft 104 includes a plurality of bristles 110 grouped together and connected (either removably or permanently) to a distal end of the handle 102. The bristles 110 may be connected together and the bristle tuft 104 may be connected directly or indirectly to the handle 102 and/or the bristles 110 may individually or in groups may be connected to the handle 102. In one embodiment, the bristle tuft 104 may be connected as a group to the handle 102 and may be secured by adhesive, fasteners, or the like. In one embodiment, the bristle tuft 104 is connected by securing the bristles together, such as by tying them together, and then the bristles are connected via adhesive to a ferrule that is then connected such as by adhesive or a fastener to the handle 102. In other embodiments, the bristles may be directly connected to the handle 102, e.g., secured by adhesive to the upper portion of the handle. However, other manners of connecting the bristle tuft 104 to the handle 102 are envisioned and the above examples are meant as illustrative only.

The handle 102 is used by a user to direct the motion of the bristle tuft 104. The handle 104 may be varied based on the desired products to be applied by the applicator 100. For example, the height, width, shape, and other features of the handle 102 may be modified (see, e.g., FIGS. 1A and 7). In one embodiment, the handle 104 may include an upper handle 120, a lower handle 122, and a neck 118 separating the upper handle 120 from the lower handle 122.

The lower handle 122 may be an elongated tubular member that includes soft or rounded edges. This shape may provide a comfortable gripping surface for the user as well as an aesthetically pleasing shape. The lower handle 122 may have a smaller diameter than the upper handle 120, which may allow the user to more easily grasp the lower handle 122 during use. Additionally, the lower handle 122 may have a height H1 that is larger than a height of the upper handle 120. Specifically, in one example, the lower handle may have a width W1 that may range between 10 to 30 mm and in one instance may be around 18 mm and may have a height H1 that may range between 60-100 mm and in one instance may be around 75 mm. The height H1 and width W1 of the lower handle 122 may be selected based on the desired products to be applied with the applicator 100.

With continued reference to FIGS. 1A-3, the handle 102 transitions from a top end of the lower handle 122 to form the neck 118. In some embodiments, the neck 118 may include an aesthetically pleasing design that highlights the transition to the upper handle 120. The upper handle 120 in combination with the neck 118 may have a height H2 that may be smaller than the height H1 and may range between 30-60 mm and in one example may be around 49 mm. Additionally, in some embodiments, the width W2 of the top end of the upper handle 120 may be larger than the width W1 of the lower handle 122. For example, the width W2 may range between 10 mm to 30 mm and in one embodiment may be 22 mm. The increased width at the upper end of the handle 120 allows the bristle tuft 104 to be larger and anchored in the handle 102. It should be noted that the design, shape, and dimensions of the handle 102 may be modified and the above examples are meant as illustrative only.

As briefly discussed above, the bristle tuft 104 is connected to a top end of the handle 102, in particular the bristle tuft 104 may be connected to the upper portion 122 of the handle 102 and in some embodiments the bristle tuft 104 may be removable from the handle 102. The bristle tuft 104 includes a plurality of bristles 110 anchored or secured to the handle 102 and are contoured to define an application end 106 for the applicator 100. In embodiments where the bristle tuft 104 is removable from the handle, the bristles 110 of the tuft 104 may be secured together independently of the handle, e.g., using adhesive, a base, or the like. In other embodiments, the bristles 110 may be individually or in groups secured to the handle 102. The application end 106 defines a topography having a plurality of application surfaces and features that may be used to apply products to a user's skin. The various features of the application end 106 will be discussed in more detail below, but generally the application end 106 and features are configured to provide multiple functions and allow various types of cosmetic products to be applied to a user's skin.

The bristles 110 may be natural hair bristles, synthetic fibers, or a combination of the two. Each of the bristles 110 may have approximately the same diameter or thickness, which may vary based on the desired uses for the applicator 100. Similarly, the density of the bristles 100 within the tuft 104 may also be varied based on the desired uses of the applicator. As some examples, the bristles 110 may have a diameter ranging between 0.10 mm and 0.01 mm, preferably around 0.07 mm. The bristles 100 may vary in texture along their length, for example, in some embodiments, the top ends of each of the bristles 110 may be softer than the body of each bristles or the bottom ends of the bristles 110.

Further, some of the bristles 110 may have different textures than others, e.g., some bristles may be softer, more rigid, or the like, than other bristles.

The length of the various bristles 110 defines the application end 106 and the contoured shape of the bristle tuft 104. For example, the bristles 110 in the middle of the bristle tuft 104 may be longest to define a first feature, whereas the bristles 110 surround the perimeter of the tuft 104 may be varying lengths to define other features. Accordingly, it should be noted that the below discussion of the contours and topography of the bristle tuft 104 is meant to describe the varying lengths of bristles 110 in certain locations within the bristle tuft 104. The bristle tuft 104 may define various shapes on different sides thereof. For example, the front and back sides may define a first type of shape whereas the right and let sides may define a second type of shape. The features of the right and left sides of the bristle tuft will now be discussed.

Figure 4:
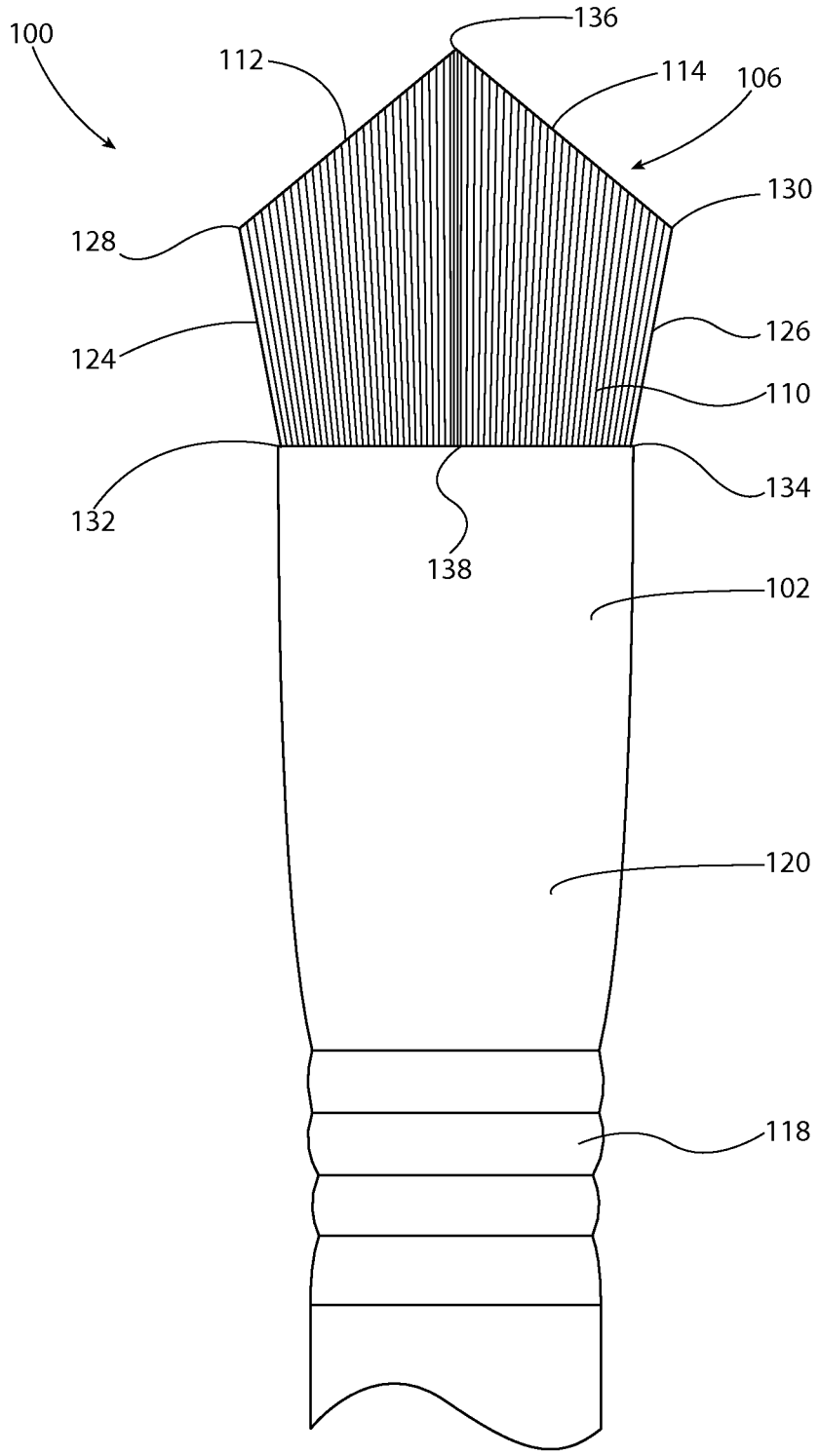
FIG. 4 is an enlarged side elevation view of the applicator.

FIG. 4 is an enlarged view of the side view of the applicator. With reference now to FIGS. 3 and 4, the features of the application end 106 will now be discussed in more detail. In one embodiment, the right and left sides of the bristle tuft 104 may define a pentagon shape. For example, a tuft side wall 108 may be defined by the bristles 110 on both the right and left sides of the applicator 100 and the application surfaces may not be defined on right and left sides. In one embodiment, the tuft side wall 108 includes a first edge wall 124 having a bottom end 132 and a top end 128 and a second edge wall 126 having a bottom end 134 and a top end 130. The bottom ends 132, 134 of each of the edge walls 124, 126 may be defined by the handle top edge 138.

The first edge wall 124 and the second edge wall 126 define the outer edges of the bristle tuft 104 as viewed from the right or left sides. Both of the edge walls 124, 126 may extend outward and upward from the respective bottom end 132, 134. In this manner, the edge walls 124, 126 may be angled relative to the upper handle 120. In one embodiment, the first edge wall 124 and the second edge wall 126 may have approximately equal lengths that may be slightly less than of width W3 between the two top ends 128, 130. For example, in one embodiment, the first edge wall 124 and the second edge wall 126 may have a length L2 that is approximately 15 mm and the width W3 between the top ends 128, 130 may be approximately 28 mm.

In one embodiment, a first angle A, or bristle extension angle, may be defined between the top end of the handle 138 and the edge walls 124, 126. The first angle A may an obtuse angle ranging between greater than 90° and less than 180° and may range between 100° and 105° and preferably 103°.

With continued reference to FIGS. 3 and 4, after the top ends 128, 130, the tuft side wall 108 transitions at the perimeter to define the first top edge 140 and a second top edge 142. The two top edges 140, 142 extend from the top ends 128, 130 towards a center of the tuft side wall 108 and define a ridge end point 136 at an intersection between the two edges 140, 142. The first top edge 140 and the second top edge 142 each extend inwards at an angle from the respective top edge 128, 130. In particular, a second angle B, e.g., a surface edge angle, may be defined between the first edge side wall 124 and the first top edge 140 and between the second edge side wall 126 and the second top edge 142. The second angle B may be obtuse, similar to the first angle A, but may be larger than the first angle A. For example, the second angle B may range from 110° to 120° and in one embodiment may be about 115°. In one embodiment, the top edges 140, 142 may have a length L1 that is approximately the same as the length L2 of the edge walls 124, 126. For example, the top edges 140, 142 may have a length approximately equal to 15 mm.

The first top edge 140 and the second top edge 142 may define a third angle C or a ridge apex angle at their intersection. In some embodiments, the third angle C may be less than both the first angle A and the second angle B, but may also be obtuse. For example, the third angle C may range between 95° and 105° and preferably may be about 100°. The various angles A, B, C of the tuft side wall 108 define the features on the front and back top ends of the bristle tuft 104, e.g., the application end 106, as will be discussed in more detail below.

The maximum width of the tuft side wall 108 may be defined between the first edge top end 128 and the second edge top end 130. In particular, a third width W may be defined between the top ends 128, 130. The third width W3 may be substantially any width, but as some examples may range between 25 mm and 35 mm and preferably may be about 28 mm. The maximum height of the tuft side wall 108 may be defined between the ridge end point 136 and the top end of the handle 138. In some embodiments, the maximum height H3 of the tuft side wall 108 may range between 20 mm and 30 mm and preferably may be around 25 mm.

In some embodiments, the right and left sides of the bristle tuft 104 may not be used to apply products to a user's face. For example, the tuft sidewall 108 may extend the entire length of the bristle tuft 104 on the right and left sides of the applicator 100. In these embodiments, the bristles 110 may be cut or contoured such that the application end 106 may be defined on the front and rear sides of the applicator 100. This configuration helps a user to better understand how to use the applicator 100 and which surfaces are meant for what tasks (e.g., contouring or coverage) and product types (e.g., cream, liquid, powder, etc.).

Figure 5:
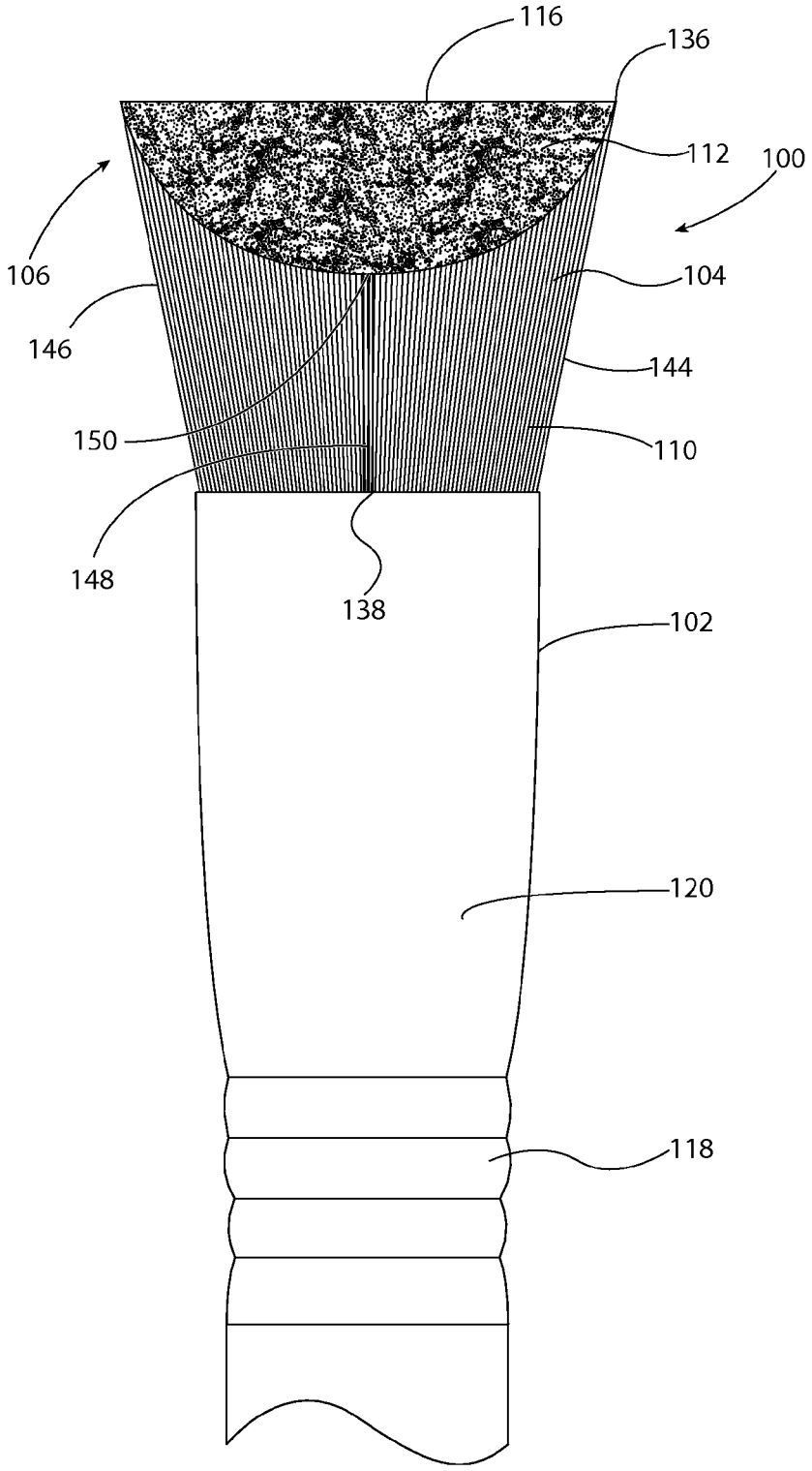
FIG. 5 is an enlarged front elevation view of the applicator.
Figure 6:
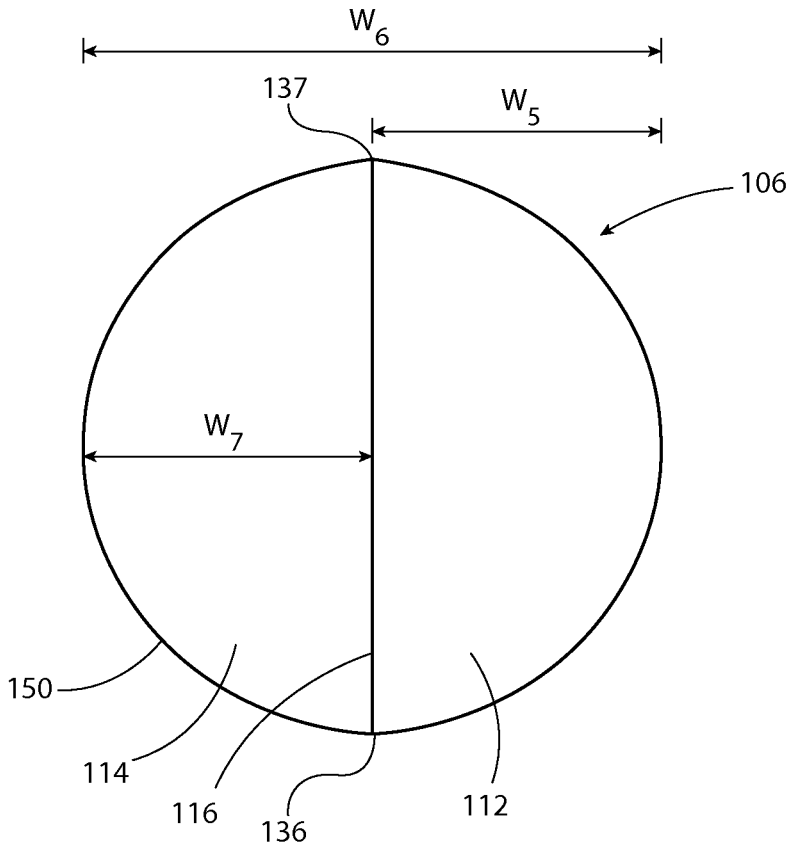
FIG. 6 is a schematic of a top plan view of an application end for the applicator of FIG. 1A.

The front and back sides of the applicator will now be discussed in more detail. FIG. 5 is an enlarged front view of the applicator. FIG. 6 is a diagram of a top plan view of the bristle tuft. With reference to FIGS. 2, 5, and 6, the front and rear sides of the bristle tuft 104 may define the application end 106 for applying product to a user's skin. In one embodiment, the application end 106 may define substantially a circular shape including a first wedge surface 112 and a second wedge surface 114 divided by a ridge 116. The two wedge surfaces 112, 114 may be used to apply cosmetic products across surfaces of a user's skin, as will be discussed in more detail below. The ridge 116 may be used to apply product into creases, lines, and other features on a user's face and may also be used to contour and provide aesthetic designs using cosmetic products.

The ridge 116 may be defined by the tallest section of bristles 110 within the bristle tuft 104, e.g., the longest bristles. The ridge 116 substantially bisects the bristle tuft 104 and extends from a first ridge end 136 to a second ridge end 137. The length or width W4 of the ridge 116 may be varied based on the diameter of the bristle tuft 104, but in some embodiments may range between 25 mm to 35 mm and preferably may be 31.67 mm. The ridge 116 may be defined by one or more rows of bristles 110 aligned within the tuft 104. By varying the number of bristle rows, the thickness of the ridge 110 may be increased or decreased as desired. Additionally, in some embodiments, the ridge 110 may include bristles 110 that are somewhat more rigid than the other bristles within the tuft 104 which may provide increased contouring abilities to the ridge 116.

The ridge 116 may define a crest for the applicator 100 and in some embodiments extends from the right side to the left side of the bristle tuft 104. In particular, the first wedge 112 and the second wedge 114 are angled upwards and intersect at the ridge 116 so that the ridge 116 defines the peak of the bristle tuft 104.

With continued reference to FIGS. 2, 5, and 6, the first and second wedges 112, 114 may be defined as substantially semicircular shaped surfaces and may be mirror images of one another. Additionally, the wedge surfaces 112, 114 may be symmetrically opposed to each other. In one embodiment, each of the wedge surface 112, 114 may have a radius or width that is approximately half of the diameter of the application end 106. For example, in one embodiment, the width W6 of the application end 106 may range between 25 mm to 35 mm and preferably around 31.67 mm and in this embodiment, the radius or width W7 of the first wedge surface 112 and the width W5 of the second wedge surface 114 may range between 12 mm to 18 mm and preferably 15.835 mm.

With reference to FIG. 2, the first wedge 112 and the second wedge 114 may be angled relative to the ridge 116. For example, a fifth angle E, or a ridge angle, may be defined between the ridge 116 and the end of the outer boundary 150 of the first wedge 112 and the second wedge 114. The angle E may be an obtuse angle and in some embodiments may be larger than angle C but less than angles A and B. In one embodiment, angle E may range between 100° and 103° and preferably 101°. Due to the angle of the first and second wedge surfaces 112, 114 the entire wedge surface 112, 114 or a substantial portion thereof may be visible from the front or rear side of the applicator 100. This angle also provides an improved angle for allowing a user to apply cosmetic products to his or her face.

In some embodiments, the front and rear sides of the bristle tuft 104 may include a length of bristles 110 that extend upwards from the upper end 138 of the handle 102 prior to defining the wedge surfaces 112, 114. With reference to FIGS. 2, 5, and 6, the bristle tuft 104 may include a front or rear wall 148 that is defined by the shape of the wedge surfaces 112, 114. For example, in some embodiments the wedge surfaces 112, 114 may be semicircular shape and the boundary wall 150 may curve downwards from the ridge ends 136, 137 downwards the top end 138 of the handle 102. In this embodiment, the height of the tuft front wall 148 (or rear wall depending on what direction the tuft is being viewed) varies along a width W2 of the handle 102. In particular, a center line of the front tuft wall 148 may have a height H5 that may be less than a height H3 of the front wall 148 at the ends 136, 137. As a specific example, the height H5 may be about 25 mm and the height H5 may be about 14 mm.

Additionally, similar to the sides of the applicator 100, the bristle tuft 104 may include front and second edge walls 144, 146 defining the shape of the bristle tuft 104 as viewed from the front and rear of the applicator 100. The first and second edge walls 144, 146 may extend outwards and upwards at an angle from the top end 138 of the handle 102. In one embodiment, a fourth angle D, or a bristle extension angle, may be defined between the top end 138 of the handle 102 or the bottom of the bristle tuft 104 and the first and second edge walls 144, 146. As with the other angles, in some embodiments, this angle D may be an obtuse angle. The angle D may be substantially the same dimensions as the angle A defined by the edge walls 124, 126 on the right and left sides of the bristle tuft. For example, the angle D may range between 100° and 103° but preferably may be about 103°.

The angles, heights, and widths discussed above are meant as illustrative only and other variations are envisioned. Also, it should be noted that although particular features are discussed as being on the right or left sides of the applicator 100, in other embodiments, these features may be on the front and back sides of the applicator 100. Further, although the various surfaces, edges, walls, and so on of the bristle tuft 104 have been discussed it should be noted that these may be the general shapes and edges defined by the bristle tuft 104. In particular, as the bristle tuft 104 includes multiple bristles 110 some bristles 110 may be slightly longer, shorter, or point in a particular direction than other bristles 110. Therefore, although the bristle tuft 104 may have a general shape, there may be stray bristles 110 or other bristles that vary from the exact boundary lines of the shapes.

Figure 7:
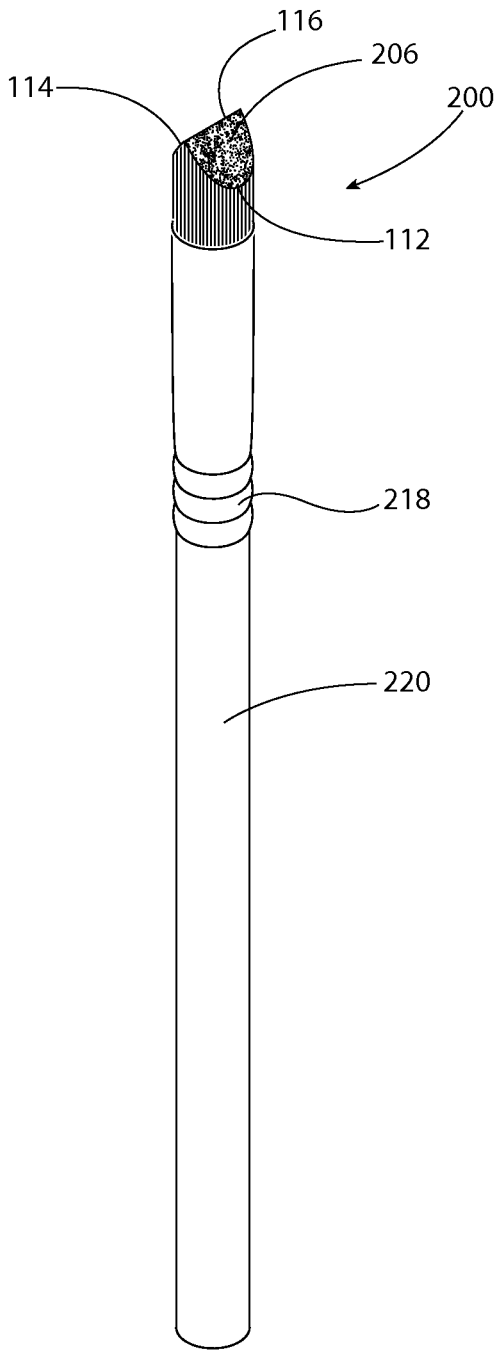
FIG. 7 is a top front isometric view of another example of an applicator.

FIG. 7 illustrates a top isometric view of another example of the applicator of the present disclosure. With reference to FIG. 7, in this example, the applicator 200 may include an elongated and thinner handle 202 as compared to the applicator 100 of FIG. 1. Additionally, the lower portion 220 of the handle may be substantially longer than the upper portion 220 as compared to the lower portion 120 of the applicator 100. Similarly, the neck 218 and upper portion 218 may have a smaller diameter than the neck 118 and upper portion 118 of the applicator 100.

The bristle tuft 204 of the applicator 200 may be substantially the same as the bristle tuft 104 and the applicator end 206 may include similar features to the applicator 100, such as the wedge surfaces 112, 114 and ridge 116, but the bristle tuft 204 and the features may be smaller. In particular, the diameter of the bristle tuft 204 may be reduced as compared to the bristle tuft 104. In this embodiment, the bristle tuft 204 may be used in smaller surface areas, such as around a user's eyes, etc., where precision may be preferred over surface area for the bristles.

Figure 8A:
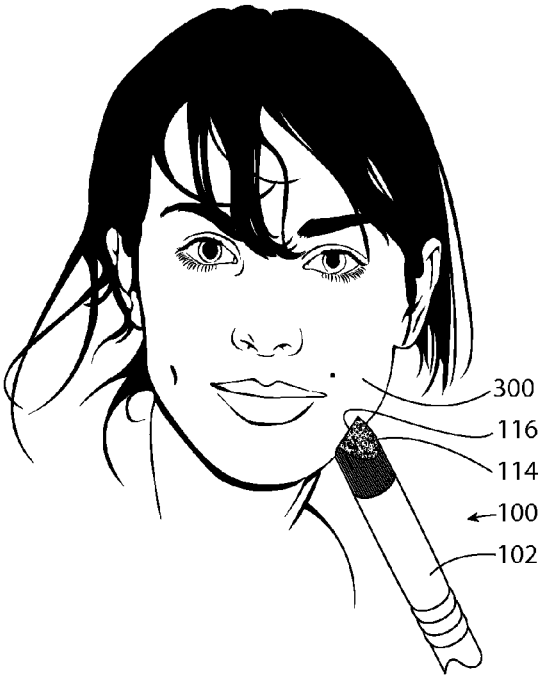
FIG. 8A is a diagram of the applicator of FIG. 1A being used to apply a cosmetic product to a user's face.

A method of using the applicator 100 for applying cosmetic products will now be discussed. FIG. 8A is a diagram of a user applying a cosmetic product with the applicator. With reference to FIGS. 1A and 8A, a user may place the first wedge surface 112 in a desired product, e.g., cream, liquid, or powder. Once the wedge surface 112 is coated or otherwise a sufficient amount of product is positioned on the bristles 110, the user directs the first wedge surface 112 to his or her face and moves the applicator 100 across his or her face. As the bristles 110 are moved, such as due to the movement of the applicator 100, the product is deposited on the user's skin 300. After the user has deposited the desired level of product onto his or her skin 300, he or she may turn the applicator 100 around so that the second wedge 114 is facing his or her skin. Using the clean wedge surface 114, the user then can smooth the product already applied to his or her skin. Because the wedge surfaces 112, 114 are substantially the same shape and size, the user can get approximately the same coverage and features as with the first wedge surface 112 but because the second wedge 114 may not include large amounts of product may be able to better smooth the previously applied product.

Figure 8B:
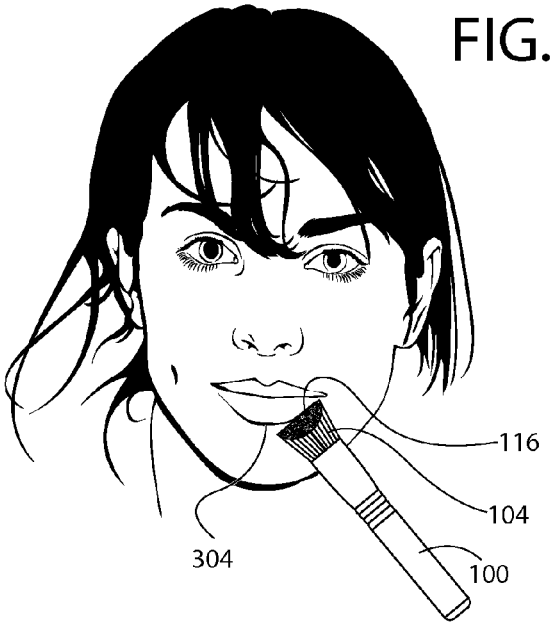
FIG. 8B is a diagram of the applicator of FIG. 1A being used to apply a cosmetic product into a crease on a user's face.
Figure 8C:
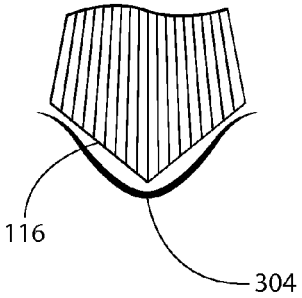
FIG. 8C is a simplified cross-section diagram of the applicator during use taken along line 8C-8C in FIG. 8A.

After the desired product has been applied, or during application, the user may tilt the applicator 100 so that the ridge 116 is somewhat perpendicular to the user's skin and touching the skin. FIG. 8B is a diagram of a user applying a cosmetic product using the ridge portion of the applicator. FIG. 8C is a cross-section view of the applicator and user's skin taken along line 8C-8C in FIG. 8B. With reference to FIGS. 8A and 8C, using the sharp angle of the ridge 116, the user can apply product into a crease 304 or other type of line or other sharp feature on his or her face or other areas of application. Additionally, the ridge 116 may be used to provide additional contouring or specific lines of product in a desired area.

Because the applicator 100 can be used for initial application, smoothing, creases, and contouring, the user can apply the cosmetic products as he or she desires but with a single multifunctional brush rather than multiple different brushes.

CONCLUSION

It should be noted that although the various examples discussed herein have been discussed with respect to cosmetic or makeup brushes, the devices and techniques may be applied in a variety of applicators, such as, but not limited to, paint brushes, cooking brushes (e.g., pastry brushes, basting brushes) and so on. As such, it should be understood that the discussion of any particular example is meant as exemplary only.

It should be noted that any of the features in the various examples and embodiments provided herein may be interchangeable and/or replaceable with any other example or embodiment. As such, the discussion of any component or element with respect to a particular example or embodiment is meant as illustrative only.

All directional references (e.g., upper, lower, upward, downward, left, right, leftward, rightward, top, bottom, above, below, vertical, horizontal, clockwise, and counterclockwise) are used only for identification purposes to aid the reader's understanding of the examples of the invention, and do not create limitations, particularly as to the position, orientation, or use of the invention unless specifically set forth in the claims. Joinder references (e.g., attached, coupled, connected, joined and the like) are to be construed broadly and may include intermediate members between the connection of elements and relative movement between elements. As such, joinder references do not necessarily infer that two elements are directly connected and in fixed relation to each other.

In some instances, components are described by reference to "ends" having a particular characteristic and/or being connected with another part. However, those skilled in the art will recognize that the present invention is not limited to components which terminate immediately beyond their point of connection with other parts. Thus the term "end" should be broadly interpreted, in a manner that includes areas adjacent rearward, forward of or otherwise near the terminus of a particular element, link, component, part, member or the like. In methodologies directly or indirectly set forth herein, various steps and operations are described in one possible order of operation but those skilled in the art will recognize the steps and operation may be rearranged, replaced or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A cosmetic brush applicator comprising:
- a handle; and
- a bristle tuft connected to the handle, the bristle tuft comprising:
  - a tuft sidewall having a first edge side wall extending from the handle on a front side of the bristle tuft and
  - a second edge side wall extending from the handle on a back side of the bristle tuft; and
- an application end configured for applying cosmetic product to a user's skin, the application end comprising:
  - a first angled surface extending upwards from the first edge side wall on the front side of the bristle tuft;
  - a second angled surface extending upwards from the second edge side wall on the back side of the bristle tuft; and
  - a ridge defined at an intersection of the first angled surface and the second angled surface;
- wherein a front of the tuft sidewall has a length less than a width of the bristle tuft and the tuft sidewall extends a length of the bristle tuft to the ridge on right and left sides of the bristle tuft.

2. The cosmetic brush applicator of claim 1, wherein the first angled surface, the second angled surface, and the ridge define a ridge apex angle at the intersection of the first and second angled surfaces on the application end of the bristle tuft.

3. The cosmetic brush applicator of claim 2, wherein the ridge apex angle is less than a bristle extension angle defined between a top end of the handle and the first edge side wall.

4. The cosmetic brush applicator of claim 3, wherein the ridge apex angle is less than a surface edge angle defined between the first edge side wall and the first angled surface.

5. The cosmetic brush applicator of claim 1, wherein the application end defines a plurality of application surfaces configured for cosmetic products to be applied to a user's skin, in which:
- the first angled surface is substantially semicircular;
- the second angled surface is substantially semicircular; and
- the ridge forms a common edge between the first angled surface and the second angled surface.

6. The cosmetic brush applicator of claim 5, wherein the bristle tuft further comprises a pentagon shaped tuft sidewall defined on at least one of the right and left sides of the bristle tuft, wherein an end of the ridge defines a point in the pentagon shaped tuft sidewall.

7. The cosmetic brush applicator of claim 1, wherein the first angled surface and the second angled surface are symmetrical mirror images of one another.

8. The cosmetic brush applicator of claim 1, wherein a maximum height of the tuft sidewall is between 20 mm and 30 mm.

9. The cosmetic brush applicator of claim 8, wherein a width of the ridge is between 25 mm and 35 mm.

10. A brush for applying cosmetic products, the brush comprising:
- a handle having a top end;
- a bristle tuft comprising a plurality of bristles arranged in a cluster and connected to the top end of the handle;
- a tuft sidewall having a first edge side wall extending from the top end of the handle and a second edge side wall extending from the top end of the handle; and
- a top end of the plurality of bristles defining an application end having application surfaces and features configured for applying cosmetic products to a user's skin, the application end defining:
  - a first wedge surface extending from the first edge side wall;
  - a second wedge surface extending from the second edge side wall; and a crest defined by a ridge at an intersection between the first wedge surface and the second wedge surface;

wherein a front of the tuft sidewall has a length less than a corresponding width of the bristle tuft and the tuft sidewall extends a length of the bristle tuft to the ridge on right and left sides of the bristle tuft.

11. The brush of claim 10, wherein the first wedge surface and the second wedge surface are mirror images of one another and the crest bisects the application end therebetween.

12. The brush of claim 10, wherein the ridge comprises longest bristles within the plurality of bristles defined by a tallest section of the bristles within the bristle tuft, wherein the ridge is defined by one or more bristle rows aligned within the bristle tuft, the ridge having a length based on a diameter of the bristle tuft and a thickness that varies with the number of the bristle rows.

13. The brush of claim 10, wherein the first wedge surface and the second wedge surface are substantially semicircular surfaces.

14. The brush of claim 13, wherein the first wedge surface is angled upwards from the front of the tuft sidewall towards the crest, the front of the tuft sidewall defined by a shape of the first wedge surface having a boundary curving downward from the ridge toward the top end of the handle, wherein the length of the front of the tuft sidewall is defined along a center line of the front of the tuft sidewall.

15. The brush of claim 10, wherein the plurality of bristles extend outwards from the top end of the handle at an obtuse brush extension angle defined between the top end of the handle and the first and second edge side walls.

16. The brush of claim 15, wherein a ridge apex angle defined at the intersection between the first and second wedge surfaces is less than the brush extension angle and a surface edge angle defined between the first edge side wall and the first wedge surface is larger than the brush extension angle.

17. The brush of claim 10, wherein a maximum height of the tuft sidewall is between 20 mm and 30 mm.

18. A cosmetic applicator for applying cosmetic products, the cosmetic applicator comprising:

a bristle tuft comprising a plurality of bristles secured together, wherein the plurality of bristles are various lengths to define a tuft sidewall having first and second edge side walls and an applicator end configured for applying cosmetic product to a user's skin, the applicator end defining a topography comprising:

a first angled wedge surface extending from the first edge side wall defined on a first side of the bristle tuft and angled towards a center of the bristle tuft;

a second angled wedge surface extending from the second edge side wall defined on a second side of the bristle tuft and angled towards the center of the bristle tuft; and a ridge defined across an intersection of the first angled wedge surface and the second angled wedge surface, wherein the ridge is defined by a tallest section of the bristles comprising a set of one or more rows of ridge bristles longer than remaining bristles in the plurality of bristles, wherein a thickness of the ridge varies with a number of the rows;

wherein a center line of a front of the tuft sidewall has a length less than a width of the bristle tuft and the tuft sidewall extends a length of the bristle tuft to the ridge on right and left sides.

19. The cosmetic applicator of claim 18, wherein the first angled wedge surface and the second angled wedge surface are mirror images of one another and the ridge bisects the bristle tuft therebetween.

20. The cosmetic applicator of claim 19, wherein the first and second angled wedge surfaces are substantially semicircular.

* * * * *